US008210707B2

(12) United States Patent
Wang

(10) Patent No.: US 8,210,707 B2
(45) Date of Patent: Jul. 3, 2012

(54) FLASHLIGHT STRUCTURE

(75) Inventor: Ching-Hsiang Wang, Tainan (TW)

(73) Assignee: Day Sun Industrial Corp., Tainan (TW)

( * ) Notice: Subject to any disclaimer, the term of this patent is extended or adjusted under 35 U.S.C. 154(b) by 114 days.

(21) Appl. No.: 12/910,899

(22) Filed: Oct. 25, 2010

(65) Prior Publication Data

US 2012/0099301 A1 Apr. 26, 2012

(51) Int. Cl.
*F21V 25/00* (2006.01)

(52) U.S. Cl. ..... 362/158; 362/196; 362/206; 362/267

(58) Field of Classification Search ..... 362/158, 362/194, 196, 199, 200, 202, 204, 205, 206, 362/267

See application file for complete search history.

(56) References Cited

U.S. PATENT DOCUMENTS

| | | | | | |
|---|---|---|---|---|---|
| 2,879,381 | A * | 3/1959 | Coffey | 362/158 |
| 4,079,243 | A * | 3/1978 | Pemberton | 362/186 |
| 4,122,510 | A * | 10/1978 | Halliday, Jr. | 362/189 |
| 4,242,724 | A * | 12/1980 | Stone | 362/158 |
| 4,443,833 | A * | 4/1984 | Fazzina | 362/189 |
| 4,628,418 | A * | 12/1986 | Chabria | 362/116 |
| 4,644,451 | A * | 2/1987 | Chabria | 362/189 |
| 4,885,666 | A * | 12/1989 | Yu | 362/189 |
| 5,806,960 | A * | 9/1998 | Chien | 362/84 |
| 6,012,824 | A * | 1/2000 | Sharrah et al. | 362/199 |
| 6,039,456 | A * | 3/2000 | Chabria | 362/189 |
| 6,817,730 | B2 * | 11/2004 | Sharrah et al. | 362/158 |
| 6,880,951 | B2 * | 4/2005 | Yoon | 362/206 |
| 7,186,002 | B2 * | 3/2007 | Matthews et al. | 362/205 |
| 7,824,063 | B2 * | 11/2010 | Frick | 362/202 |

* cited by examiner

*Primary Examiner* — John A Ward

(74) *Attorney, Agent, or Firm* — Alan Kamrath; Kamrath IP Lawfirm, PA

(57) ABSTRACT

Provided is an improved flashlight structure applicable to a flashlight for use at special sites. The flashlight structure includes a press switch whose protruding end is constantly received in a recessed area. Therefore, should the flashlight be dropped, with the press switch facing down, the press switch will not be pressed inward (and hence turned on or off) by accident. Also, the flashlight structure includes a partition plate for separating batteries in the flashlight and preventing the batteries from overheating due to close contact. A lighting unit connected to the open end of the flashlight structure is peripherally provided with ribs of different widths for engaging with the corresponding slots and thus positioning the lighting unit properly. An annular isolation portion in the middle section of the press switch is tightly engaged with the inner periphery of an end hole of the flashlight structure to prevent entry of external moisture.

5 Claims, 5 Drawing Sheets

FLASHLIGHT STRUCTURE

BACKGROUND OF THE INVENTION

1. Technical Field

The present invention relates to an improved flashlight structure. More particularly, the present invention relates to a flashlight structure applicable to a flashlight for use in mines, gas tanks, spray painting sites, and so on, wherein the flashlight structure includes a press switch that will not be accidentally pressed (and hence turned on or off) if the flashlight is dropped to the ground, wherein a partition plate serves to separate the batteries in the flashlight and thereby prevent the batteries from overheating due to close contact between the batteries, and wherein a lighting unit connected to the open end of the flashlight structure is peripherally provided with ribs of different widths for engaging with the corresponding slots and thus positioning the lighting unit properly during assembly, so as to provide the flashlight with enhanced anti-explosion protection.

2. Description of Related Art

Nowadays, flashlights are available in a variety of configurations designed for specific uses. For example, a flashlight for use in mines, gas tanks, spray painting sites, and so on must have a main body that is anti-explosion and impermeable to external moisture. A flashlight of this kind typically includes a pre-shaped main body, a lighting unit installed at the front end of the main body, a grip portion formed in the middle section of the main body, and a press switch provided between the lighting unit and the grip portion or at one end of the flashlight, wherein the press switch is configured to make or break electrical connection between a conductive plate and the batteries in the flashlight. The grip portion has an end through which the batteries can be inserted and to which a cap is tightly secured by rotation to cover the end.

However, the foregoing conventional flashlight for use at special sites has its shortcomings. For example, the press switch is very likely to be inadvertently pressed, thus turning on or off flashlight by accident. If the flashlight is turned off unexpectedly, the sudden loss of light may put the user in danger. If the flashlight is turned on without the user knowing it, not only is the electricity in the batteries wasted, but also the current generated by turning on the flashlight may cause sparks and thereby ignite the gas or powder particles at the working site. In addition, the batteries in the aforesaid conventional flashlight are typically arranged in rows, say, an upper row and a lower row when the flashlight is placed horizontally, wherein the batteries in the upper row are in direct contact or are allowed to make such contact with the batteries in the lower row. After the flashlight is used for a while or left unused for a long time, with the batteries inside the flashlight, the batteries may release a small amount of liquid. If the liquid of the upper-row batteries interacts with that of the adjoining lower-row batteries, the service lives of the batteries may be shortened.

BRIEF SUMMARY OF THE INVENTION

The present invention provides an improvement over the conventional flashlights for use at special sites. It is hoped that, with the present invention, the press switch of a flashlight will not be accidentally pressed when the flashlight is dropped to the ground; the batteries in the flashlight will be separated by a partition plate provided between the batteries to prevent them from overheating due to close contact; and a lighting unit disposed at the open end of the flashlight is peripherally provided with structures of different widths that are engageable with the corresponding structures at the open end of the flashlight to allow proper positioning during assembly, thereby providing the flashlight with enhanced anti-explosion protection.

Hence, the primary object of the present invention is to provide a flashlight structure applicable to a flashlight for use at special sites, wherein the flashlight structure includes a main body, a press switch, a partition plate, a lighting unit, a cap, and a plurality of batteries. The main body has an inner periphery concavely provided with two opposite grooves along which the partition plate is inserted to divide the interior space of the main body, thereby separating the batteries in the main body and preventing the batteries from overheating due to close contact between the batteries. The main body further has an open end whose inner periphery is provided with a relatively narrow slot and a relatively wide slot which are offset from the two grooves. A relatively narrow rib and a relatively wide rib protrudingly provided on a periphery of the lighting unit are inserted respectively into the two slots during assembly to provide proper positioning. Thus, the corresponding components of the flashlight are easily aligned to enable accurate assembly of the flashlight.

The second object of the present invention is to provide the foregoing flashlight structure, wherein the lighting unit includes a middle cover, a connecting element, and a front cover that are positioned and fastened by a plurality of screws, and wherein the middle cover has spaces through which the screws pass and which are provided respectively with insulating pads. Thus, after a rear cover connected with a substrate is fastened to the middle cover, insulation between the middle and rear covers of the lighting unit is ensured.

The third object of the present invention is to provide the foregoing flashlight structure, wherein the rear cover connected with the substrate is fastened to the middle cover by engagement between at least one hook extending from one end of the rear cover and at least one corresponding notch formed on the middle cover. Thus, the rear cover can be rapidly positioned with respect to the middle cover during assembly and easily disconnected from the middle cover to facilitate replacement of damaged components.

The fourth object of the present invention is to provide the foregoing flashlight structure, wherein the main body has a second end that is opposite the open end and penetrated by a hole. The press switch can be inserted all the way into the main body until a protruding end of the press switch juts out of the hole. In addition, the hole has an outer periphery which is adjacent to the protruding end of the press switch and which also forms a recessed area. Thus, the protruding end of the press switch is constantly received in the recessed area and is prevented from being pressed inward (and hence turning on or off the press switch) by accident when the flashlight is dropped to the ground with the second end facing down.

The fifth object of the present invention is to provide the foregoing flashlight structure, wherein the press switch inserted in the interior space of the main body has a middle section formed as an annular isolation portion. The annular isolation portion is pressed tightly against the inner periphery of the hole at the second end of the main body, thereby isolating the interior space of the main body from the outside and preventing external moisture from entering the interior space.

BRIEF DESCRIPTION OF THE SEVERAL VIEWS OF THE DRAWINGS

The structure as well as a preferred mode of use, further objects, and advantages of the present invention will be best understood by referring to the following detailed description of an illustrative embodiment in conjunction with the accompanying drawings, in which.

DETAILED DESCRIPTION OF THE INVENTION

Figure 3:
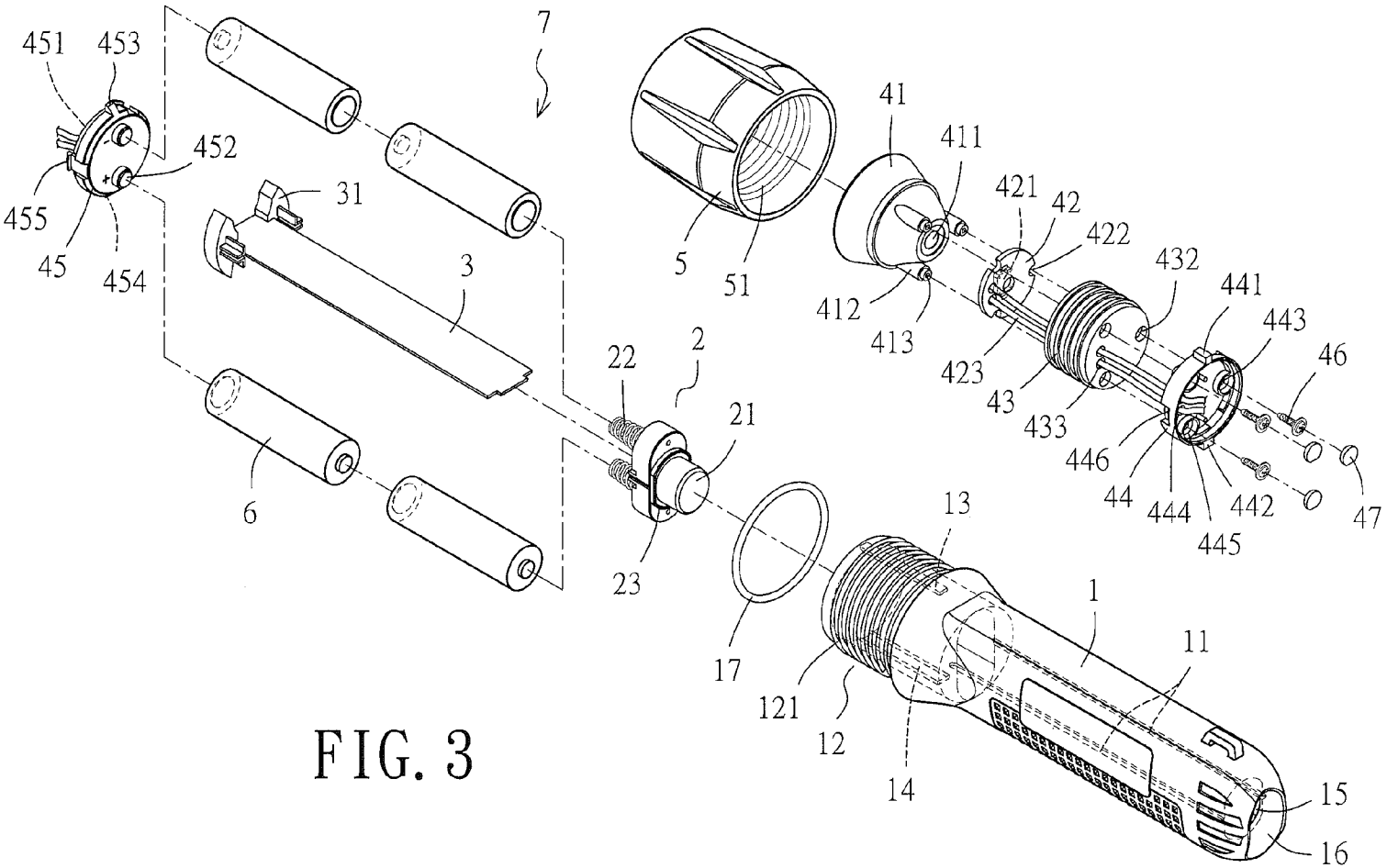
FIG. 3 is an exploded perspective view of the flashlight shown in FIG. 1.

Referring to FIG. 3, an improved flashlight structure according to the present invention is applied to a flashlight 7 for use at special sites and includes a main body 1, a press switch 2, a partition plate 3, a lighting unit 4, a cap 5, and a plurality of batteries 6.

The main body 1 has an inner periphery concavely provided with two opposite grooves 11. The main body 1 further has an open end 12 whose inner periphery is formed with a relatively narrow slot 13 and a relatively wide slot 14, wherein the two slots 13, 14 are offset from the two grooves 11. The end opposite the open end 12 (hereinafter referred to as the second end) is penetrated by a hole 15, whose outer periphery forms a recessed area 16.

The press switch 2 has one end formed as a pressing portion 21 and the other end connected with a pair of spaced-apart springs 22. The middle section of the press switch 2 forms an annular isolation portion 23.

The partition plate 3 is a dividing plate whose width is determined by the spacing between the two opposite grooves 11 concavely provided on the inner periphery of the main body 1. Provided at one end of the partition plate 3 is a bilateral limiting portion 31.

Figure 6:
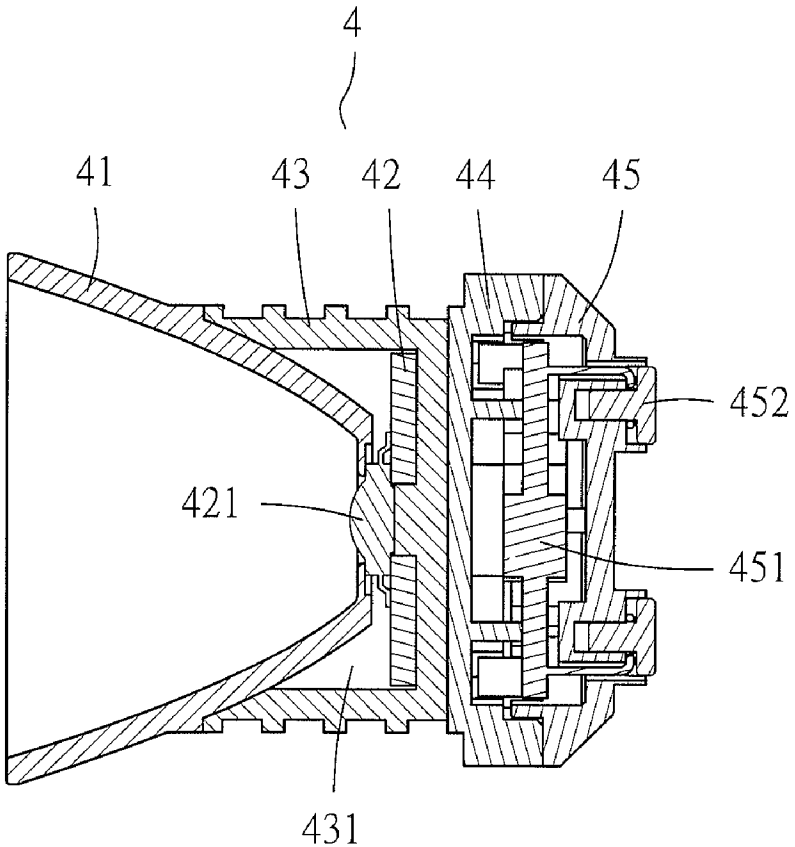
FIG. 6 is a sectional view taken along line 60-60 in FIG. 5.
Figure 5:
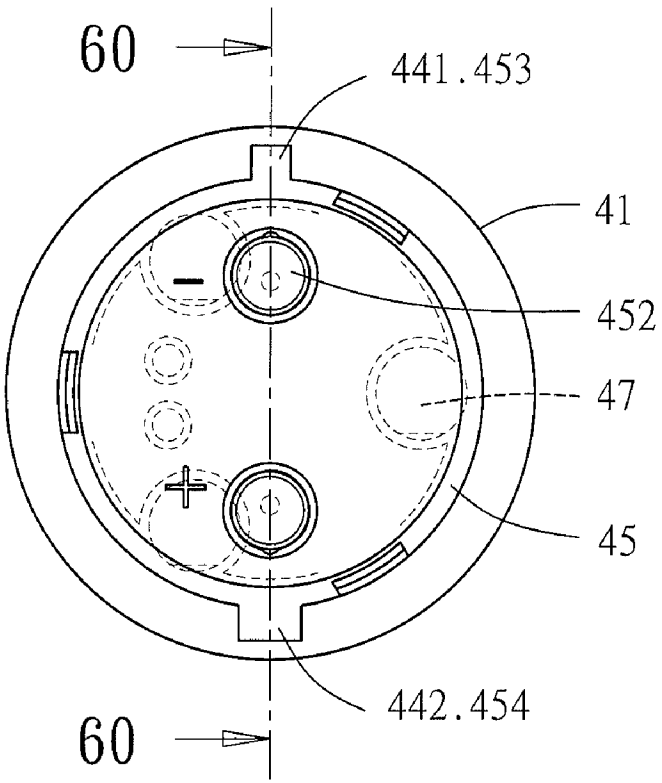
FIG. 5 is an end view of a lighting unit of the flashlight shown in FIG. 1.

The lighting unit 4 includes a front cover 41, a plate 42 connected with an LED 421, a connecting element 43, a middle cover 44, and a rear cover 45. The front cover 41 is centrally provided with a hole 411 corresponding in position to the LED 421 connected to the plate 42, as shown in FIG. 6. The rear end of the front cover 41 is extended with at least one supporting portion 412, wherein each supporting portion 412 is provided therein with a threaded hole 413. After assembly, the supporting portions 412 are pressed respectively against notches 422 concavely provided around the periphery of the adjacent plate 42. The connecting element 43 defines a space 431 therein for receiving the plate 42 and the front cover 41. The rear end of the connecting element 43 is penetrated by holes 432, whose spacing is determined by the spacing between the supporting portions 412 of the front cover 41. The rear end of the connecting element 43 is further provided with wire holes 433 corresponding in position to the conductive wires 423 extending from the LED 421 of the plate 42. A relatively narrow rib 441 and a relatively wide rib 442 extend respectively from opposite positions on the periphery of the middle cover 44. In addition, the middle cover 44 has a surface provided with holes 443 and wire holes 444 corresponding in position to the holes 432 and the wire holes 433 of the connecting element 43, wherein each hole 443 has a rear end concavely provided with a space 445. After a plurality of screws 46 are inserted through the holes 443, 432 of the middle cover 44 and the connecting element 43 and then screwed into the corresponding threaded holes 413 of the front cover 41, the exposed ends of the screws 46 are pressed against the corresponding spaces 445 of the middle cover 44. Then, a plurality of insulating pads 47 are placed respectively in the spaces 445 outside the exposed ends of the screws 46 to ensure insulation in the lighting unit 4. Apart from that, the middle cover 44 is peripherally provided with notches 446 offset from the relatively narrow rib 441 and the relatively wide rib 442. As to the rear cover 45, a substrate 451 is connected to one side of the rear cover 45 to connect with the conductive wires 423 extending from the LED 421 of the plate 42. The conductive wires 423 are further connected to conductive pads 452 at the rear end of the rear cover 45. Further, the rear cover 45 is peripherally provided with a relatively narrow rib 453 and a relatively wide rib 454 that are opposite each other. The front end of the rear cover 45 is extended with at least one hook 455 (corresponding in position to the notches 446 of the middle cover 44 and offset from the relatively narrow rib 453 and the relatively wide rib 454) for engaging with the notches 446 formed on the periphery of the adjacent middle cover 44, as shown in FIG. 5. Thus, the rear cover 45 not only can be rapidly connected to the middle cover 44, but also can be easily disconnected therefrom to facilitate the replacement of damaged components.

The cap 5 has an inner periphery formed with a threaded section 51 for threaded engagement with a threaded section 121 on the outer periphery of the open end 12 of the main body 1.

The plural batteries 6, which serve as the power source of the flashlight 7, are inserted in the interior space of the main body 1 that is divided by the partition plate 3.

Figure 1:
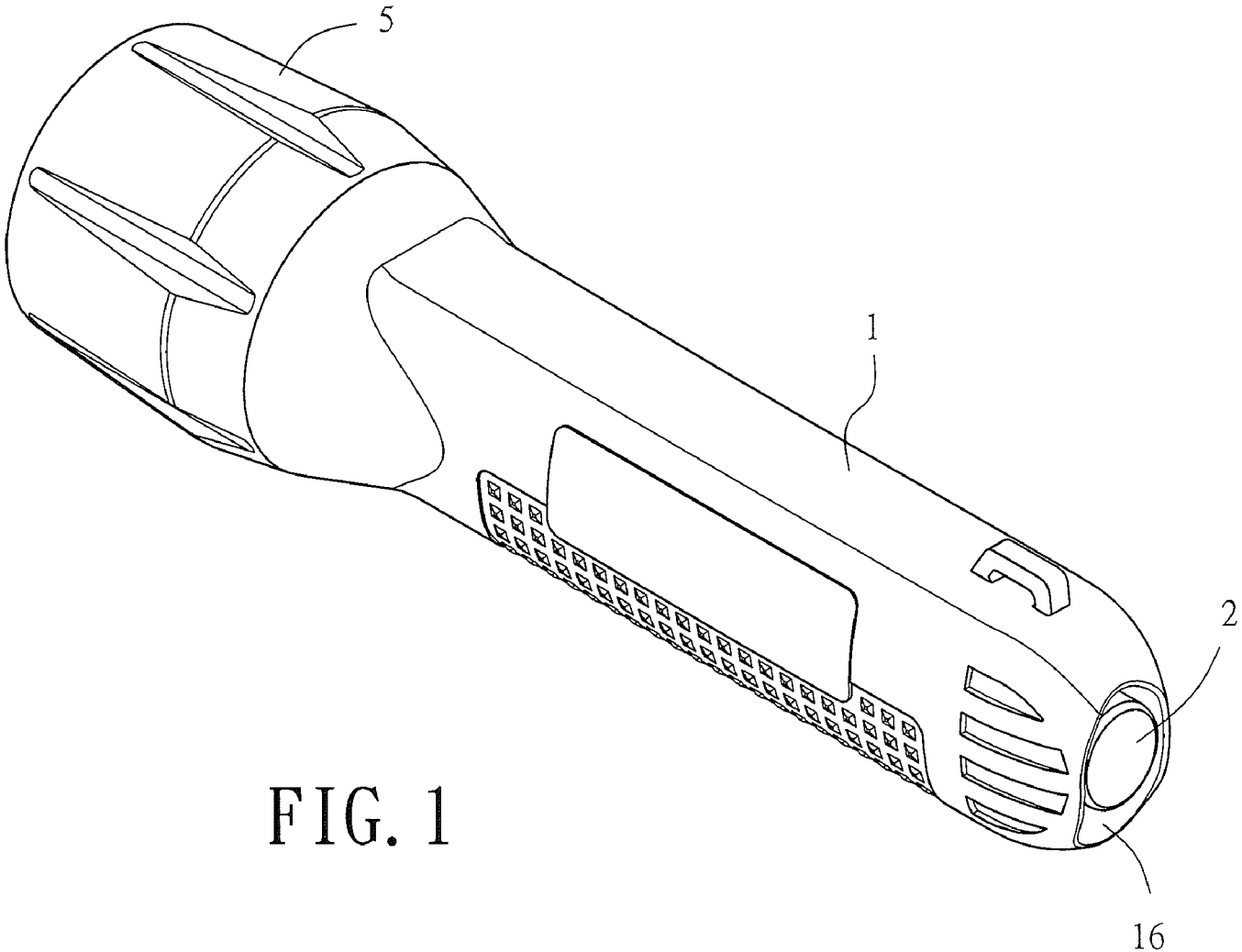
FIG. 1 is a perspective view of a flashlight using the flashlight structure of the present invention.
Figure 2:
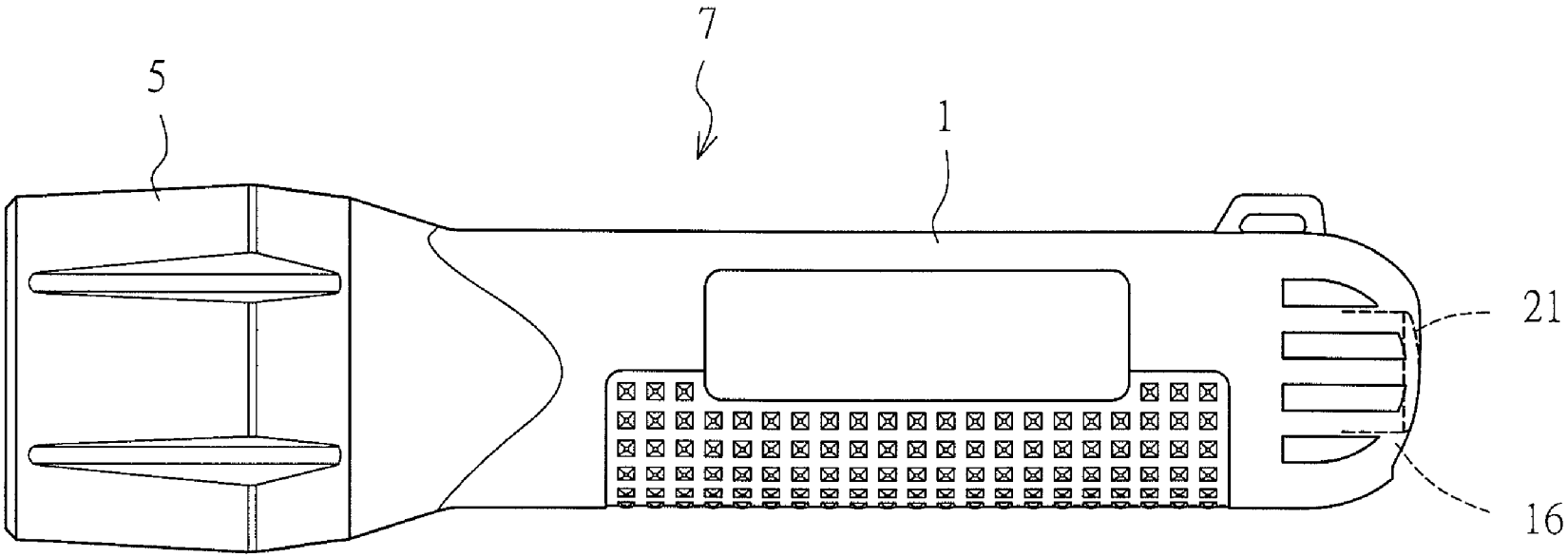
FIG. 2 is a front view of the flashlight shown in FIG. 1.
Figure 4:
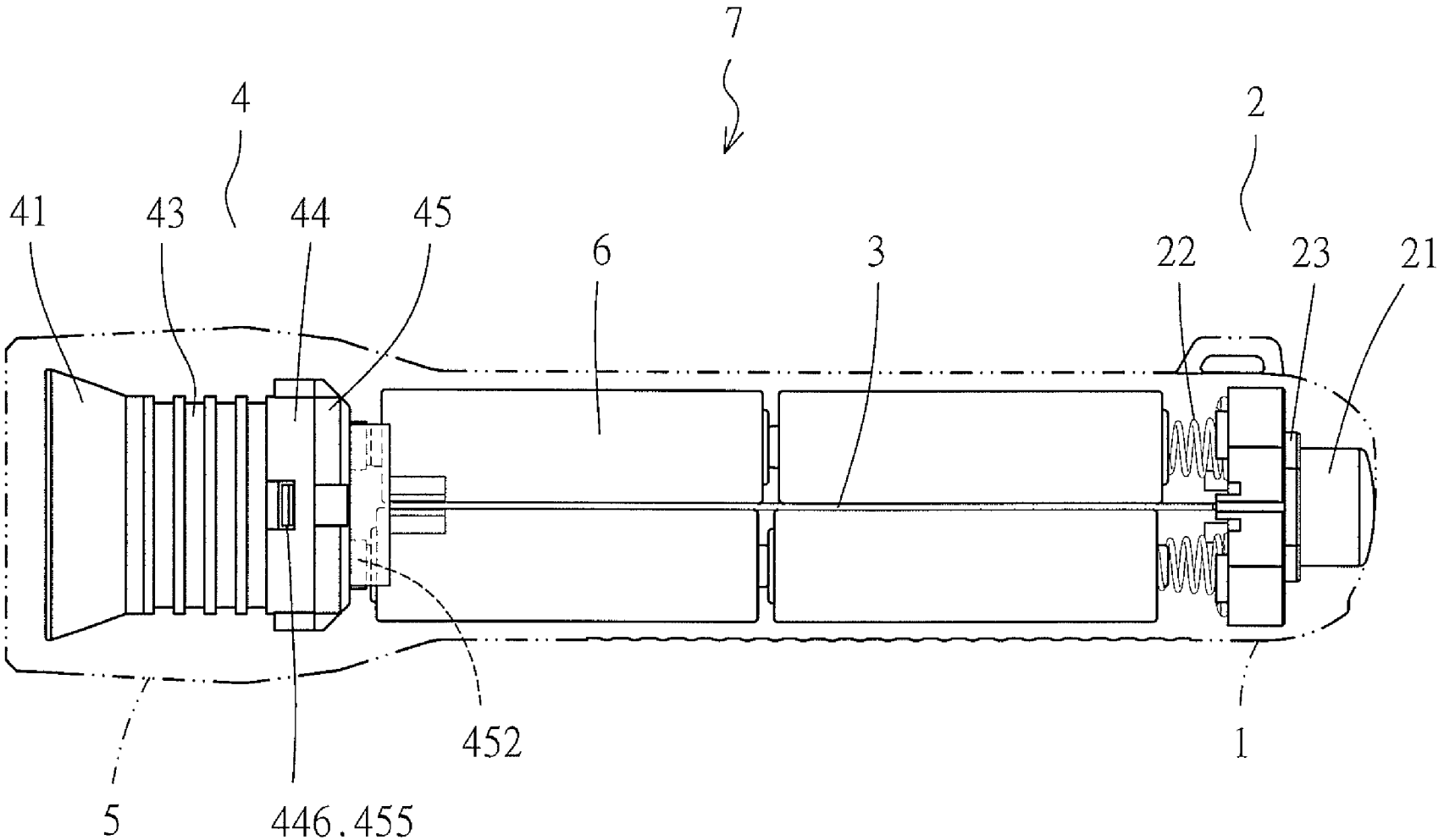
FIG. 4 is a see-through view of the flashlight shown in FIG. 1.

The main body 1, the press switch 2, the partition plate 3, the lighting unit 4, the cap 5, and the plural batteries 6 are put together in the following manner. Referring to FIG. 4, the press switch 2 is inserted all the way through the open end 12 of the main body 1 until the pressing portion 21 at one end of the press switch 2 passes through the hole 15 at the opposite end (i.e., second end) of the main body 1. Consequently, the pressing portion 21 juts out of but remains received in the recessed area 16 on the outer periphery of the hole 15, as shown in FIGS. 1 and 2. Meanwhile, the annular isolation portion 23 in the middle section of the press switch 2 is pressed tightly against the inner periphery of the hole 15 at the second end of the main body 1 to isolate the interior space of the main body 1 from the outside, thereby preventing external moisture from entering the main body 1. Next, the partition plate 3 is inserted into the main body 1 along the two opposite grooves 11 on the inner periphery thereof so as to divide the interior space of the main body 1. Following that, the batteries 6 are installed in the divided interior space of the main body 1 and are therefore separated by the partition plate 3. Afterward, the relatively narrow ribs 441, 453 and the relatively wide ribs 442, 454 protruding from the periphery of the lighting unit 4 are inserted respectively into the relatively narrow slot 13 and the relatively wide slot 14 formed on the inner periphery of the open end 12 of the main body 1, thus bringing the lighting unit 4 into proper alignment with the main body 1. Then, an O-ring 17 is mounted around the inner end of the threaded section 121 of the main body 1, and the cap 5 is subsequently screwed on the threaded section 121 of the open end 12 of the main body 1, thereby completing the flashlight 7 for use at special sites.

While the flashlight 7 is carried around or in use, the protruding end of the press switch 2 is always received in the recessed area 16, as shown in FIG. 1. Therefore, should the flashlight 7 be inadvertently dropped, with the second end facing down, the press switch 2 will not be pressed inward and hence will not be turned on or off by accident. Besides, as the batteries 6 installed inside the flashlight 7 are separated by the partition plate 3, the batteries 6 will not overheat because of close contact therebetween. In addition, as the annular isolation portion 23 in the middle section of the press switch 2 is tightly engaged with the inner periphery of the hole 15 at the second end of the main body 1 to provide isolation between the inside and outside of the main body 1, external moisture is prevented from entering the main body 1 while the flashlight 7 is carried around or used.

What is claimed is:

1. A flashlight structure, comprising a main body, a press switch, a partition plate, a lighting unit, a cap, and a plurality of batteries, the flashlight structure being characterized in that:

the main body has an inner periphery concavely provided with two opposite grooves along which the partition plate is inserted into an interior space of the main body to divide the interior space and thereby prevent the batteries installed in the divided interior space from overheating due to close contact between the batteries; and the main body further has an open end, wherein the open end has an inner periphery provided with a relatively narrow slot and a relatively wide slot which are offset from the two grooves and into which a relatively narrow rib and a relatively wide rib extending from a periphery of the lighting unit are respectively inserted during assembly to facilitate alignment of flashlight components during the assembly.

2. The flashlight structure of claim 1, wherein the lighting unit comprises a middle cover, a connecting element, and a front cover which are positioned and fastened by a plurality of screws, the middle cover having spaces through which the screws pass and which are provided respectively with insulating pads for providing insulation between the middle cover and an adjacent rear cover of the lighting unit, the rear cover being fastened to the middle cover and connected with a substrate.

3. The flashlight structure of claim 2, wherein the rear cover of the lighting unit that is connected with the substrate is fastened to the adjacent middle cover by engagement between at least a hook extending from an end of the rear cover and at least a notch formed on the middle cover and corresponding in position to the at least a hook, thus not only allowing the rear cover to be rapidly positioned with respect to the middle cover during the assembly, but also allowing the rear cover to be easily disconnected from the middle cover to facilitate replacement of damaged components.

4. The flashlight structure of claim 1, wherein the main body further has a second end located opposite the open end and penetrated by a hole, and the press switch is inserted into the main body until a protruding end of the press switch protrudes from the hole, the hole having an outer periphery adjacent to the protruding end of the press switch and forming a recessed area in which the protruding end of the press switch is constantly received, thereby preventing the press switch from being turned on/off by being pressed inward when the flashlight structure is accidentally dropped with the second end of the main body facing down.

5. The flashlight structure of claim 1, wherein the press switch inserted in the interior space of the main body has a middle section formed as an annular isolation portion, the annular isolation portion being pressed tightly against an inner periphery of a hole at a second end of the main body, thus isolating the interior space of the main body from outside and preventing entry of external moisture.

* * * * *